US005820247A

United States Patent [19]

Schuler

[11] Patent Number: 5,820,247

[45] Date of Patent: Oct. 13, 1998

[54] MODULAR COVER

[75] Inventor: Norman F. Schuler, West Chester, Ohio

[73] Assignee: NuTone Inc., Cincinnati, Ohio

[21] Appl. No.: 612,024

[22] Filed: Mar. 5, 1996

[51] Int. Cl.[6] ..... F21V 29/00; F21V 17/00; F21S 1/02; F24F 13/078

[52] U.S. Cl. ..... 362/96; 362/147; 362/148; 362/149; 362/294; 362/364; 362/366; 362/373

[58] Field of Search ..... 362/96, 147, 148, 362/149, 364, 294, 373, 366

[56] References Cited

U.S. PATENT DOCUMENTS

| | | | |
|---|---|---|---|
| Re. 34,709 | 8/1994 | Tyson | 362/96 |
| 2,689,906 | 9/1954 | Corbett . | |
| 2,697,163 | 12/1954 | Spear . | |
| 3,001,056 | 9/1961 | Spear . | |
| 4,681,024 | 7/1987 | Ivey | 362/149 |
| 4,729,080 | 3/1988 | Fremont et al. | 362/366 |
| 4,862,334 | 8/1989 | Ivey et al. | 362/149 |
| 4,930,054 | 5/1990 | Krebs | 362/149 |
| 5,122,936 | 6/1992 | Guthrie | 362/294 |
| 5,373,431 | 12/1994 | Hayman et al. | 362/364 |
| 5,548,499 | 8/1996 | Zadeh | 362/366 |
| 5,651,609 | 7/1997 | Pelton et al. | 362/294 |

*Primary Examiner*—Ira S. Lazarus
*Assistant Examiner*—Matthew Spark
*Attorney, Agent, or Firm*—Wood, Herron & Evans, L.L.P.

[57] ABSTRACT

A modular cover for a combination light source and ventilator system is disclosed. The modular cover includes a grill, a light-transmissive lens and an optionally detachable trimplate for mounting beneath the light source and ventilator system installed in a ceiling. The trimplate is releasably engagable with the grill for covering a greater portion of the ceiling in the event a sizing error is made during installation of the light source and ventilator system. Preferably, the lens is releasably engagable with the grill for changing of the light source and cleaning of the lens.

9 Claims, 2 Drawing Sheets

MODULAR COVER

FIELD OF THE INVENTION

The present invention relates generally to lighting and ventilation system covers and, more particularly, to combined lens and grill covers for bathrooms and the like.

BACKGROUND OF THE INVENTION

Combination light source and ventilator systems are often found in household bathrooms, for example, to provide necessary illumination and also to exhaust air from the room. Typically, the lighting and ventilation system is recessed in the ceiling of the bathroom with the system being secured to suitable structural members above the ceiling level. In accordance with known installation practice, a combined lens and grill cover is mounted beneath the lighting and ventilation system to provide an aesthetic appearance to the ceiling. The lens is made of a suitable material to diffuse light from the light source while the grill is configured to communicate with the ventilator for drawing high humidity, moisture-laden, air from the bathroom.

To install known recessed lighting and ventilation systems, it is necessary for a hole to be cut in the ceiling at the desired location of the system within the room, with the size of the hole being generally determined by the dimension of the lighting and ventilation system and also the spacing between ceiling joists. This cutting process often leaves rough edges around the periphery of the hole which are then hidden by the cover when it is mounted to the ceiling beneath the system. As known lens and grill covers are typically dimensioned slightly larger than the dimension of the associated lighting and ventilation system, a relatively small margin of error is provided in the design of the cover to accommodate for sizing mistakes made during installation of the system in a ceiling. Notwithstanding this provision, however, known cover designs cannot accommodate for cutting mistakes made in the ceiling which exceed the size of the combined lens and grill cover. That is, when the size of the hole is accidently made larger than the dimension of the combined lens and grill cover, the ceiling must be patched before a new hole of appropriate size can be made. However, while patching may provide a solution to the sizing error problem, it is a time consuming process which may ultimately result in a finished ceiling having undesirable and detectable flaws.

Accordingly, a primary object of the present invention is to provide a combined lens and grill cover assembly for a lighting and ventilation system which can easily accommodate for sizing errors made during installation of the system in a ceiling.

Another object of the present invention is to provide such a combined cover assembly which is easy to install beneath the lighting and ventilating system.

SUMMARY OF THE INVENTION

To these ends, a modular cover is provided for installation beneath a combination light source and ventilator system installed in a ceiling. The modular cover includes a grill having a central opening, an intermediate ported ring disposed about the central opening and an outwardly directed flange disposed about and integral with the ported ring. The ported ring communicates with the ventilator system to draw air from a room ventilated by the combination lighting and ventilation system, such as a bathroom, for example. Preferably, the grill includes a resilient clip member which cooperates with a conventional receiving structure in the ceiling such that the cover can be pulled away from the ceiling to provide access to the light source and ventilator system.

A light-transmissive lens is disposed in the central opening of the grill for diffusing light from the light source. In a preferred embodiment, the lens is releasably engagable with the grill for changing of the light source or cleaning of the lens. In this preferred embodiment, the lens includes a laterally directed flange overlying a portion of the grill and a series of notches spaced about the flange. The grill includes a series of spaced latching tabs disposed about the central opening of the grill and in register with the spaced notches of the lens such that the latching tabs are releasably engagable in the notches to detachably join the grill and lens.

An optionally detachable trimplate is provided having a central opening for receiving the grill and lens combination, with the outwardly directed flange of the grill overlying a portion of the trimplate. Preferably, the outwardly directed flange of the grill includes a series of notches spaced about the flange. The trimplate includes a series of spaced latching tabs disposed about its outer periphery and in register with the spaced notches of the grill such that the latching tabs are releasably engagable in the notches to detachably join the trimplate and grill. In this way, the trimplate is optionally provided to accommodate for sizing mistakes made during installation of the light source and ventilator system in a ceiling.

BRIEF DESCRIPTION OF THE DRAWINGS

The accompanying drawings, which are incorporated in and constitute a part of this specification, illustrate an embodiment of the invention and, together with the general description of the invention given above and the detailed description of an embodiment given below, serve to explain the principles of the present invention.

DETAILED DESCRIPTION OF THE INVENTION

Figure 1:
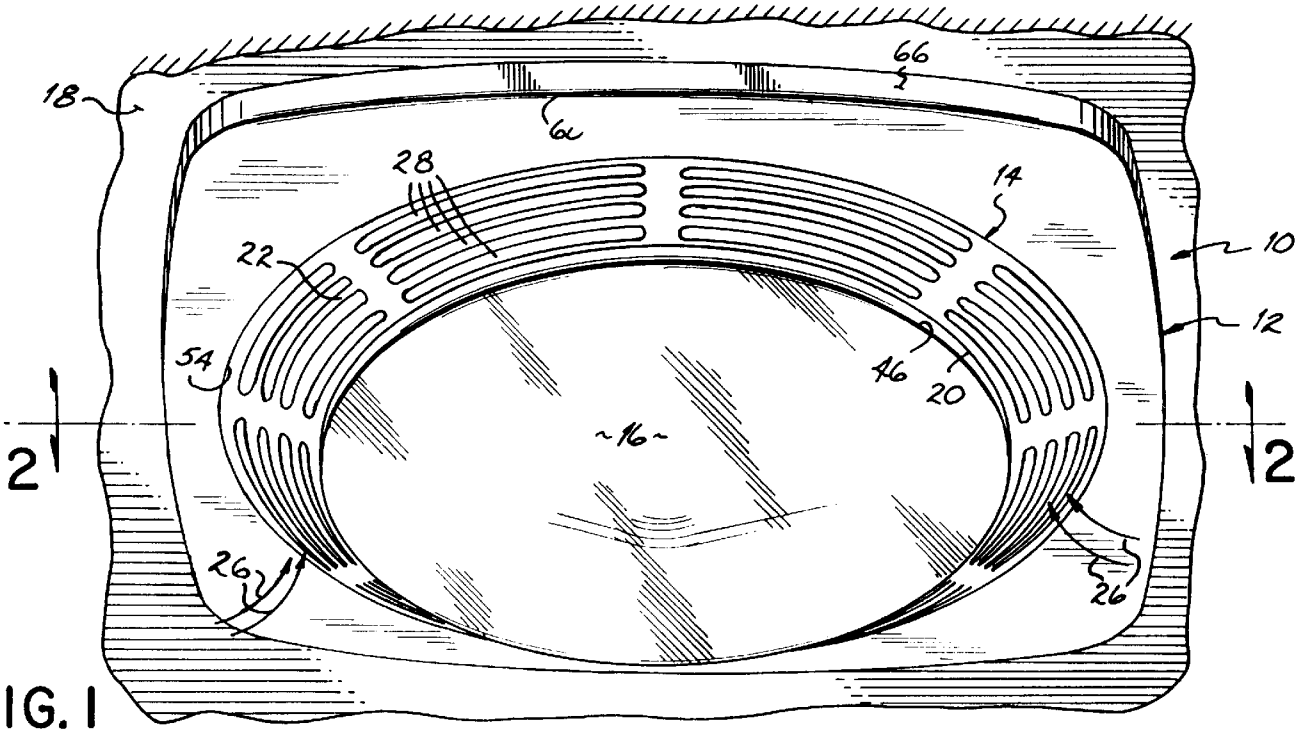
FIG. 1 is a perspective view showing a modular cover in accordance with the present invention mounted on a ceiling beneath a combination light source and ventilator system.

With reference to FIG. 1, a modular cover 10 is shown in accordance with the present invention. Modular cover 10 includes a dished trimplate 12, a grill 14 and a light-transmissive lens 16 for mounting beneath a combination light source and ventilator system installed in a ceiling 18, such as in a bathroom, for example. The grill 14 preferably includes a pair of resilient clip members (not shown) which are slidably attached to a conventional receiving structure in the ceiling 18. In this way, the modular cover 10 can be pulled away from the ceiling 18 to provide access to the light source and ventilator system, as required.

As will be described in more detail below, the trimplate 12 is releasably engagable with the grill 14 such that the trimplate is optionally provided to accommodate for mistakes made during installation of the lighting and ventilation system in the ceiling 18. That is, in one embodiment, the trimplate 12 is removed, with the grill 14 and lens 16 being provided to cover the combination light source and ventilator system. In another embodiment, the trimplate 12 is mounted with the grill 14 and lens 16, as shown in FIG. 1, to cover a greater portion of the ceiling 18 in the event a sizing error was made during installation of the lighting and ventilation system. Preferably, the lens 16 is likewise releasably engagable with the grill 14 for changing of the light source and cleaning of the lens, as required.

Figure 2:
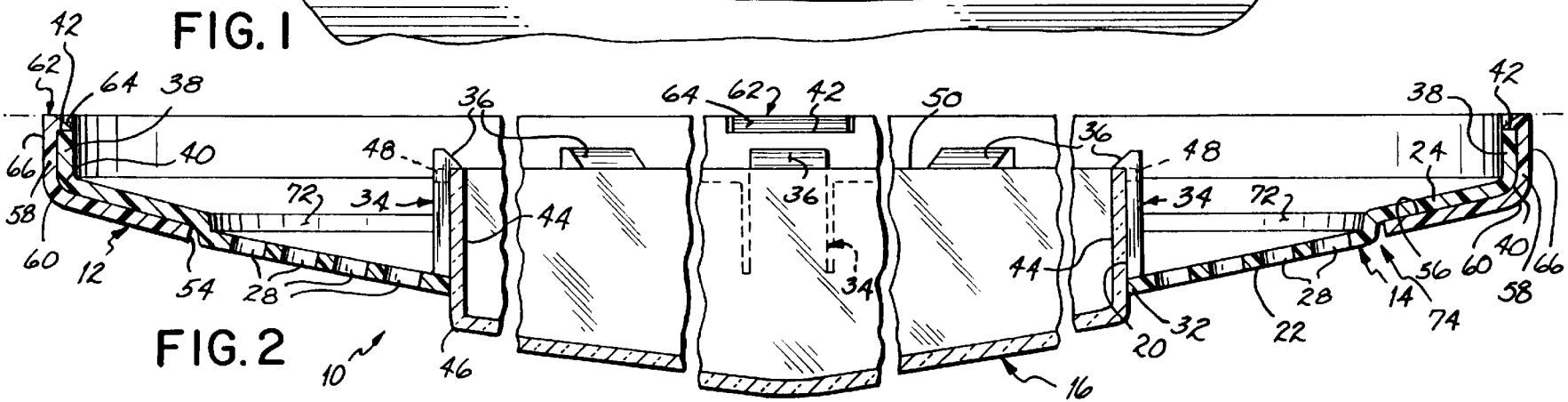
FIG. 2 is a cross-sectional view of the modular cover shown in FIG. 1 taken along lines 2—2 of FIG. 1.
Figure 3:
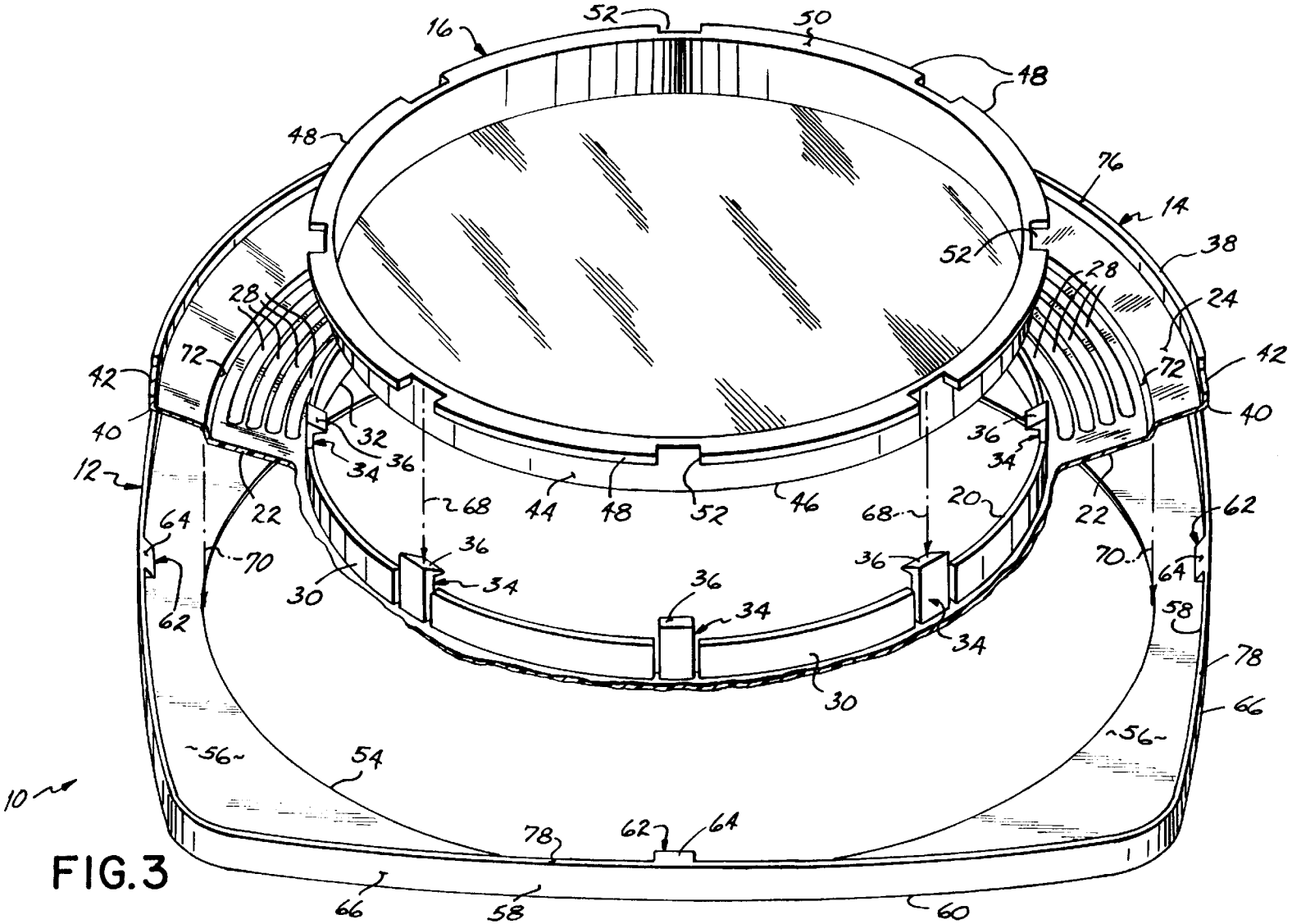
FIG. 3 is an exploded perspective view of the modular cover shown in FIG. 1.

Referring now to FIGS. 2 and 3, the grill 14, made of a plastic material or the like, includes a central opening 20 sized to receive the lens 16, an intermediate ported ring 22 disposed about the central opening and an outer flange 24 disposed about and integral with the ported ring. The grill 14 is in communication with the ventilator system to draw air, shown diagrammatically by arrows 26 in FIG. 1, from a room ventilated by the combination lighting and ventilation system. Preferably, the ported ring 22 includes a series of arcuate slots 28 communicating with the ventilator system, but modifications to the ported ring can be made without departing from the spirit of the present invention. The grill 14 includes an inner vertical flange 30 attached to or integral with the ported ring 22 and extending upwardly from an inner periphery 32 of the grill. A series of flexible, spaced latching tabs 34 having inwardly directed teeth or dogs 36 are provided for releasably engaging the lens 16 as will be described in detail below. An integral outer vertical flange 38 extends upwardly from an outer periphery 40 of the grill 14 and includes a series of spaced U-shaped notches 42 for releasably engaging the trimplate 12 in accordance with the present invention.

The lens 16 is made of a suitable material to diffuse light from the light source and is dimensioned to be received within the central opening 20 of the grill 14. The lens 16 includes an integral vertical flange 44 extending upwardly from an outer periphery 46 of the lens and a laterally directed flange 48 extending from a top surface 50 of the vertical flange 44. Preferably, the laterally directed flange 48 is attached to or integral with the vertical flange 44 and includes a series of spaced U-shaped notches 52 for releasably engaging the grill as described below in greater detail.

With further reference to FIGS. 2 and 3, the trimplate 12, also made of plastic material or the like, includes a central opening 54 dimensioned to receive the grill 14 and lens 16 combination, with the outer flange 24 of the grill overlying a dished portion 56 of the trimplate. The trimplate 12 includes an integral outer vertical flange 58 extending upwardly from an outer periphery 60 of the trimplate and a series of latching tabs 62 having inwardly directed teeth or dogs 64 spaced medially on each of its sides 66. It will be appreciated that while the grill 14 and lens 16 have been shown as being circular at their respective outer peripheries 40 and 46, and while the trimplate 12 has been shown as being generally rectangular at its outer periphery 60, it will be appreciated that modifications may be made to these structures without departing from the spirit of the present invention.

In order to assemble the modular cover 10, the lens 16 is inserted into the central opening 20 of the grill 14 with the latching tabs 34 of the grill in register with the notches 52 of the lens. The lens 16 is inserted into the grill 14, such as downwardly as shown by arrows 68 in FIG. 3, until the teeth or dogs 36 of the latching tabs 34 resiliently ride over and rest upon a portion of the inner vertical flange 30 of the grill. In this position, the laterally directed flange 48 overlies and is supported by the inner vertical flange 30 of the grill 14 with the latching tabs 34 preventing upward movement of the lens 16 relative to the grill. If the trimplate 12 is required to accommodate for a sizing mistake made in the ceiling 18 during installation of the light source and ventilator system, the joined grill 14 and lens 16 combination is inserted into the central opening 54 of the trimplate with the latching tabs 62 of the trimplate in register with the notches 42 of the grill. The grill 14 and lens 16 combination is inserted into the trimplate 12, such as downwardly as shown by arrows 70 in FIG. 3, until the teeth or dogs 64 of the latching tabs 62 resiliently ride over and rest upon the outer vertical flange 38 of the grill. In this position, the outer flange 24 of the grill 14 overlies and rests upon the dished portion 56 of the trimplate 12 with the latching tabs 62 preventing upward movement of the grill relative to the trimplate. Preferably, the grill 14 includes a step or shoulder 72 intermediate the ported ring 22 and the outer flange 24 such that the dished portion 56 of the trimplate 12 and the ported ring form a substantially continuous conical surface 74, as shown most clearly in FIG. 2. A pair of resilient clip members (not shown) are attached to the grill 14 and slidably engaged in a conventional receiving structure in the ceiling such that the modular cover 10 can be pulled away from the ceiling to provide access to the combination lighting and ventilation system. Those skilled in the art will appreciate that other mechanical structures, including reversal of parts, are available for joining trimplate 12, grill 14 and lens 16 without departing from the spirit of the present invention.

Thus, in accordance with the present invention, the grill 14 and lens 16 combination are adapted to be mounted to the ceiling 18 beneath the lighting and ventilation system. In one embodiment (not shown), a top surface 76 (see FIG. 3) of the grill 14 engages the ceiling 18 through an upward force applied by the resilient clip members. If a sizing mistake is made in the ceiling 18 during installation of the light source and ventilation system, the optional trimplate 12 is attached to the grill 14 and lens 16 combination, with a top surface 78 of the trimplate (see FIG. 3) engaging the ceiling surface as shown in FIG. 1. In this way, installation errors are easily accommodated through the additional mounting of the trimplate 12 with the grill 14 and lens 16.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of applicant's invention.

Having described the invention.

What is claimed is:

1. A modular cover for a combination light source and ventilator system, comprising:

a grill having a central opening and a plurality of ports disposed about said central opening, said ports communicating with said ventilator system during operation thereof;

a light-transmissive lens disposed in said central opening of said grill for diffusing light from said light source; and a trimplate having a central opening for receiving said grill and lens combination, said trimplate releasably cooperating with said grill whereby said trimplate is optionally provided to accommodate for mistakes made during installation of said light source and ventilator system in a ceiling, one of said grill and said trimplate having a plurality of spaced latching tabs disposed about an outer periphery thereof and the other having a plurality of spaced notches disposed about an outer periphery thereof in register with said respective latching tabs whereby said latching tabs are selectively releasably engagable with said notches to detachably join said grill and trimplate.

2. The modular cover of claim 1 wherein said ports comprise a plurality of arcuate slots disposed about said central opening in said grill.

3. The modular cover of claim 1 wherein said lens releasably cooperates with said grill.

4. The modular cover of claim 3 wherein said lens includes a laterally directed flange overlying a portion of said grill and further includes a plurality of notches spaced about said flange.

5. The modular cover of claim 4 wherein said grill includes a plurality of spaced latching tabs disposed about said central opening in said grill and in register with said spaced notches of said lens whereby said latching tabs are releasably engagable in said notches to detachably join said grill and lens.

6. The modular cover of claim 1 wherein said grill includes an outwardly directed flange overlying a portion of said trimplate and further includes a plurality of notches spaced about said flange.

7. The modular cover of claim 6 wherein said trimplate includes a plurality of spaced latching tabs disposed about an outer periphery thereof and in register with said spaced notches of said grill whereby said latching tabs are releasably engagable in said notches to detachably join said grill and trimplate.

8. A modular cover for a combination light source and ventilator system, comprising:

a grill having a central opening, an intermediate ported ring disposed about said central opening, and an outer flange disposed about and integral with said ported ring, said ported ring communicating with said ventilator system during operation thereof;

a light-transmissive lens disposed in said central opening of said grill for diffusing light from said light source; and a trimplate having a central opening for receiving said grill and lens combination with said outer flange of said grill overlying a portion of said trimplate, said trimplate releasably cooperating with said grill whereby said trimplate is optionally provided to accommodate for mistakes made during installation of said light source and ventilator system in a ceiling, one of said grill and said lens having a plurality of spaced notches and the other having a plurality of spaced latching tabs in register with said notches whereby said latching tabs are releasably engagable in said notches to detachably join said grill and lens, one of said grill and said trimplate having a plurality of spaced notches and the other having a plurality of spaced latching tabs in register with said notches whereby said latching tabs are releasably engagable in said notches to detachably join said grill and trimplate.

9. A modular cover for a combination light source and ventilator system, comprising:

a grill having a central opening, an inner vertical flange extending upwardly from an inner periphery of said grill and including a plurality of spaced latching tabs, an intermediate ported ring disposed about said central opening, an outer flange disposed about and integral with said ported ring, and an outer vertical flange extending upwardly from an outer periphery of said grill and including a plurality of spaced notches, said ported ring communicating with said ventilator system during operation thereof;

a light-transmissive lens disposed in said central opening of said grill for diffusing light from said light source, said lens including a vertical flange extending upwardly from an outer periphery of said lens and a flange directed laterally from said vertical flange of said lens, said laterally directed flange including a plurality of notches spaced about said flange and in register with said latching tabs of said grill whereby said latching tabs are releasably engagable in said notches to detachably join said grill and lens; and a trimplate having a central opening for receiving said grill and lens combination with said outer flange of said grill overlying a portion of said trimplate, said trimplate including an outer vertical flange extending upwardly from an outer periphery thereof and a plurality of latching tabs spaced about said outer vertical flange and in register with said notches of said grill, said latching tabs being releasably engagable in said notches to detachably join said trimplate and said grill whereby said trimplate is optionally provided to accommodate for mistakes made during installation of said light source and ventilator system in a ceiling.

* * * * *